US006792242B2

(12) United States Patent
Suzaki

(10) Patent No.: US 6,792,242 B2
(45) Date of Patent: Sep. 14, 2004

(54) MANUAL PAPER FEEDING APPARATUS

(75) Inventor: Yoshikazu Suzaki, Mishima (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/445,897

(22) Filed: May 28, 2003

(65) Prior Publication Data

US 2003/0223793 A1 Dec. 4, 2003

(30) Foreign Application Priority Data

May 29, 2002 (JP) ..... 2002-155494

(51) Int. Cl.[7] ..... G03G 15/14; G03G 15/00; B65H 5/22

(52) U.S. Cl. ..... 399/392; 399/18; 399/20; 399/21; 399/388; 399/393; 399/397; 399/390; 271/4.08; 271/8.1; 271/82; 271/207; 271/280

(58) Field of Search ..... 399/392, 388, 399/393, 390, 397, 18, 20, 21; 271/4.08, 8.1, 82, 207, 280

(56) References Cited

U.S. PATENT DOCUMENTS 5,655,206 A * 8/1997 Miyazawa ..... 399/361
6,157,799 A * 12/2000 Asakura et al. ..... 399/167
6,412,771 B1 * 7/2002 Hirata et al. ..... 271/116
6,530,706 B2 * 3/2003 Sugimoto et al. ..... 400/625
6,618,565 B2 * 9/2003 Tamiya et al. ..... 399/66

FOREIGN PATENT DOCUMENTS

JP 6-001492 A 1/1994

* cited by examiner

*Primary Examiner*—Andrew H. Hirshfeld
*Assistant Examiner*—Marvin P Crenshaw
(74) *Attorney, Agent, or Firm*—Foley & Lardner LLP

(57) ABSTRACT

A manual paper feeding apparatus comprises a tray for manual paper feeding, a paper feed roller to feed the paper fed manually from the tray, a separation roller which is pressed to contact the paper feed roller, rotated at the pressed contact position in the direction reverse to the paper feed roller, and separates the sheets of paper one by one, a power transmission device to transmit power to the paper feed roller and separation roller, and a reversing device which is provided in the power transmission device, and rotates the paper feed roller in the direction reverse to the paper feeding direction, based on that the paper fed between the paper feed roller and separation roller is pulled in the direction reverse to the manual feeding direction.

4 Claims, 4 Drawing Sheets

MANUAL PAPER FEEDING APPARATUS

CROSS-REFERENCE TO RELATED APPLICATIONS

This application is based upon and claims the benefit of priority from the prior Japanese Patent Application No. 2002-155494, filed May 29, 2002, the entire contents of which are incorporated herein by reference.

BACKGROUND OF THE INVENTION

1. Field of the Invention

The present invention relates to a manual paper feeding apparatus which manually feeds paper to an electrophotographic copier, for example.

2. Description of the Related Art

There is a conventional paper feeding apparatus of this type, which is built in the open/close door provided on the side of the main unit of a copier. This manual paper feeding apparatus is provided with a tray for manual paper feeding. Paper is manually fed from this tray and taken in with a pickup roller, and fed between a paper feed roller and a separation roller. By the rotation of the paper feed roller and separation roller, the sheets of paper are separated one by one, held and carried by a pair of carry rollers, and supplied to an image transfer unit.

However, paper may cause a jam during manual paper feeding. When a paper jam occurs, the door is opened and the manual paper feeding apparatus is removed from the copier, and the jammed paper is removed.

In the conventional manual paper feeding apparatus, a pressure release mechanism is provided, which interlocks with the opening of the door, releases the pressure applied to the paper by separating the paper feed roller and separation roller, and the jammed paper is removed. Thus, there arises inconvenience that a pressurizing mechanism is required, the cost rises, and paper is damaged when the door is opened.

BRIEF SUMMARY OF THE INVENTION

The present invention has been made to eliminate the above inconvenience. It is an object of the present invention is to provide a manual paper feeding apparatus which can easily remove a paper jam without requiring a pressure release mechanism and opening an open/close door.

According to a first aspect of the present invention, there is provided a manual paper feeding apparatus comprising a tray for manual paper feeding; a paper feed roller to feed the paper fed manually from the tray; a separation roller which is pressed to contact the paper feed roller, and rotated at the pressed contact position in the direction reverse to the paper feed roller, and separates the sheets of paper one by one; a power transmission device to transmit power to the paper feed roller and separation roller; and a reversing device which is provided in the power transmission device, and rotates the paper feed roller in the direction reverse to the paper feeding direction, based on that the paper fed to between the paper feed roller and separation roller is pulled in the direction reverse to the manual feeding direction.

According to a second aspect of the present invention, there is provided a manual paper feeding apparatus comprising a tray to receive the paper fed manually; a pickup roller to pick up the paper fed manually to the tray; a paper feed roller to feed the paper picked up by the pickup roller; a separation roller which is pressed to contact the paper feed roller, and rotated at the pressed contact position in the direction reverse to the paper feed roller, and separates the paper one by one; a pair of carry rollers to hold and carry the paper fed by the paper feed roller; a power transmission device to transmit power to the pair of carry rollers, paper feed roller and separation roller; and a reversing device which rotates the carry roller and paper feed roller in the direction reverse to the paper feeding direction, based on that the paper fed to between the paper feed roller and separation roller, and between the pair of carry rollers, is pulled in the direction reverse to the manual feeding direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

The present invention will be explained in detail hereinafter with reference to the embodiments shown in the attached drawings.

Figure 1:
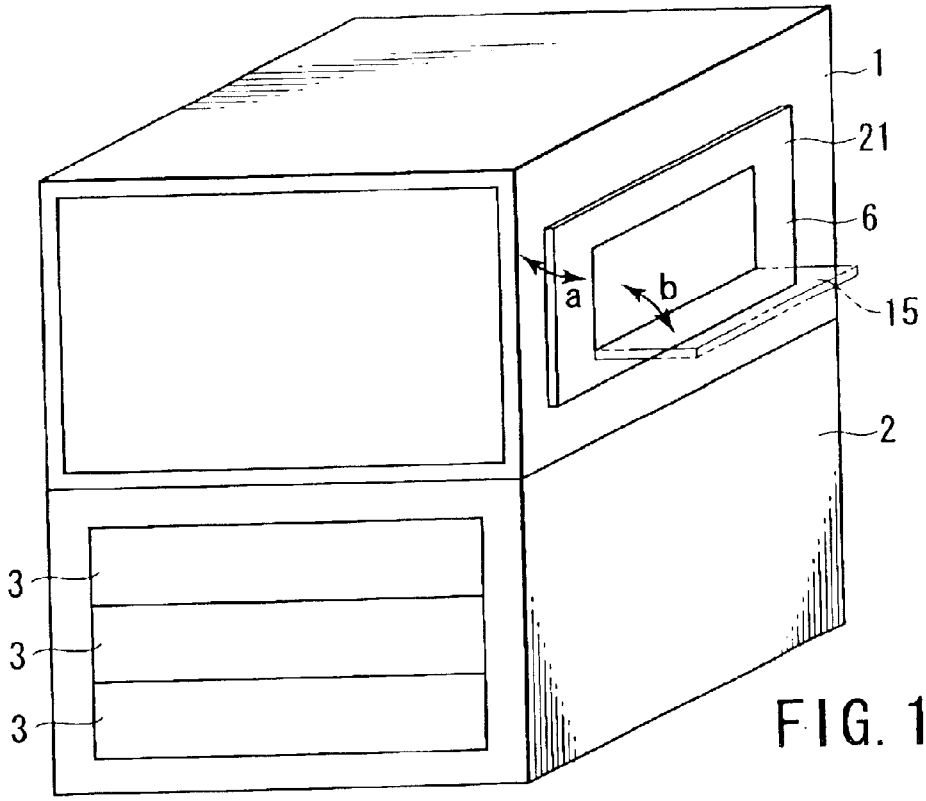
FIG. 1 is a external perspective view showing an image forming apparatus according to one embodiment of the present invention.

FIG. 1 is a external perspective view showing an electrophotographic copier as an image forming apparatus according to one embodiment of the present invention.

The reference numeral 1 in the drawing denotes the main unit of an electrophotographic copier, which is mounted on the top of a paper feeding apparatus 2.

The paper feeding apparatus 2 is provided with a multiple stages of paper feed cassette 3, which contains paper of various sizes. The paper in the paper feed cassette 3 is taken out one by one by a paper feed mechanism not shown in the drawing, and supplied to a unit to receive paper (an image transfer unit) in the main unit 1.

An image forming unit 5 explained later is provided in the main unit 1, and a manual paper feeding unit 6 for manual paper feeding is provided in one side of the main unit 1 as a manual paper feeding device.

Figure 2:
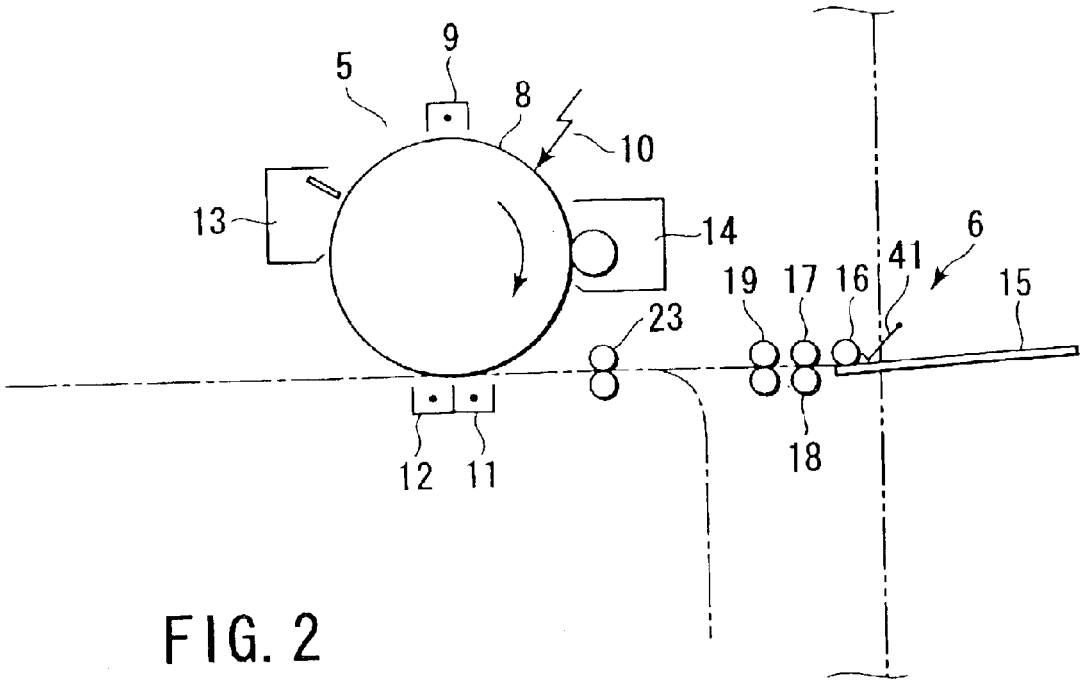
FIG. 2 is a view showing the configuration of the image forming unit and a manual paper feeding unit.

FIG. 2 shows an image forming unit 5 and a manual paper feeding unit 6.

The image forming unit 5 is provided with a photoconductive drum 8 rotative in the arrow direction. In the circumference of the photoconductive drum 8, an electrification charger 9, an exposing unit 10, a developing unit 14, a transfer/separation charger 11/12, and c cleaning unit 13 are sequentially provided along the drum rotating direction.

When forming an image, the electrification charger 9 electrifies uniformly the surface of the photoconductive drum 8 to a predetermined potential. The exposing unit 10 forms an electrostatic latent image corresponding to image information on the surface of the electrified photoconductive drum 8. The electrostatic latent image is sent by the rotation of the photoconductive drum 8 to the position opposite to the developing unit 14, where the developing unit 14 supplies toner to the latent image and makes a toner image. The toner image is sent to the position opposite to the transfer charger 11, where the toner image is transferred to paper by the function of the transfer charger 11. The toner image transferred paper is separated from the photoconductive drum 8 by the function of the separation charger 12. The separated paper is sent to a fixing unit (not shown) to be fixed there, and ejected from the unit.

The toner remained on the surface of the photoconductive drum 8 after the transfer of the toner image is eliminated by the cleaning unit 13, and then, the image forming process will be repeated.

The manual paper feeding unit 6 comprises a paper tray 15, a pickup roller 16, a paper feed roller 17, a separation roller 18, a pair of carry rollers 19, and a detection lever 41 to detect the paper fed manually.

Figure 3:
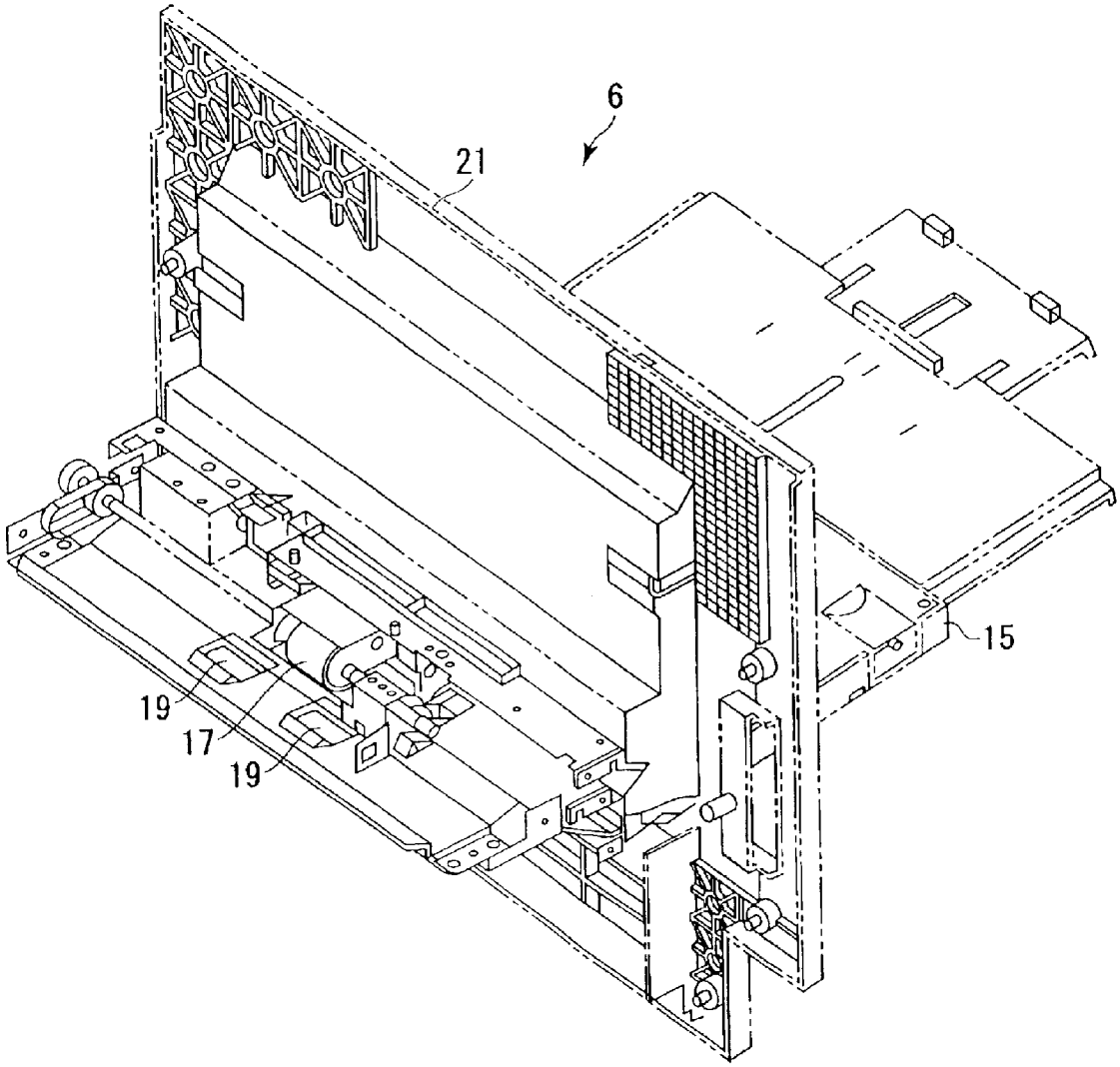
FIG. 3 is a perspective view showing the manual paper feeding unit.

The manual paper feeding unit 6 is as shown in FIG. 3 is contained in an open/close door 21 as one unit therewith. The open/close door 21 is as shown in FIG. 1 provided rotatively on one side of the main unit 1, and opens/closes in the arrow direction.

The paper tray 15 is rotatively provided on the open/close door 21. Namely, the paper tray 15 is opened outward when it is used, and rotated inward to be contained in the door 21 when it is not used.

Figure 4:
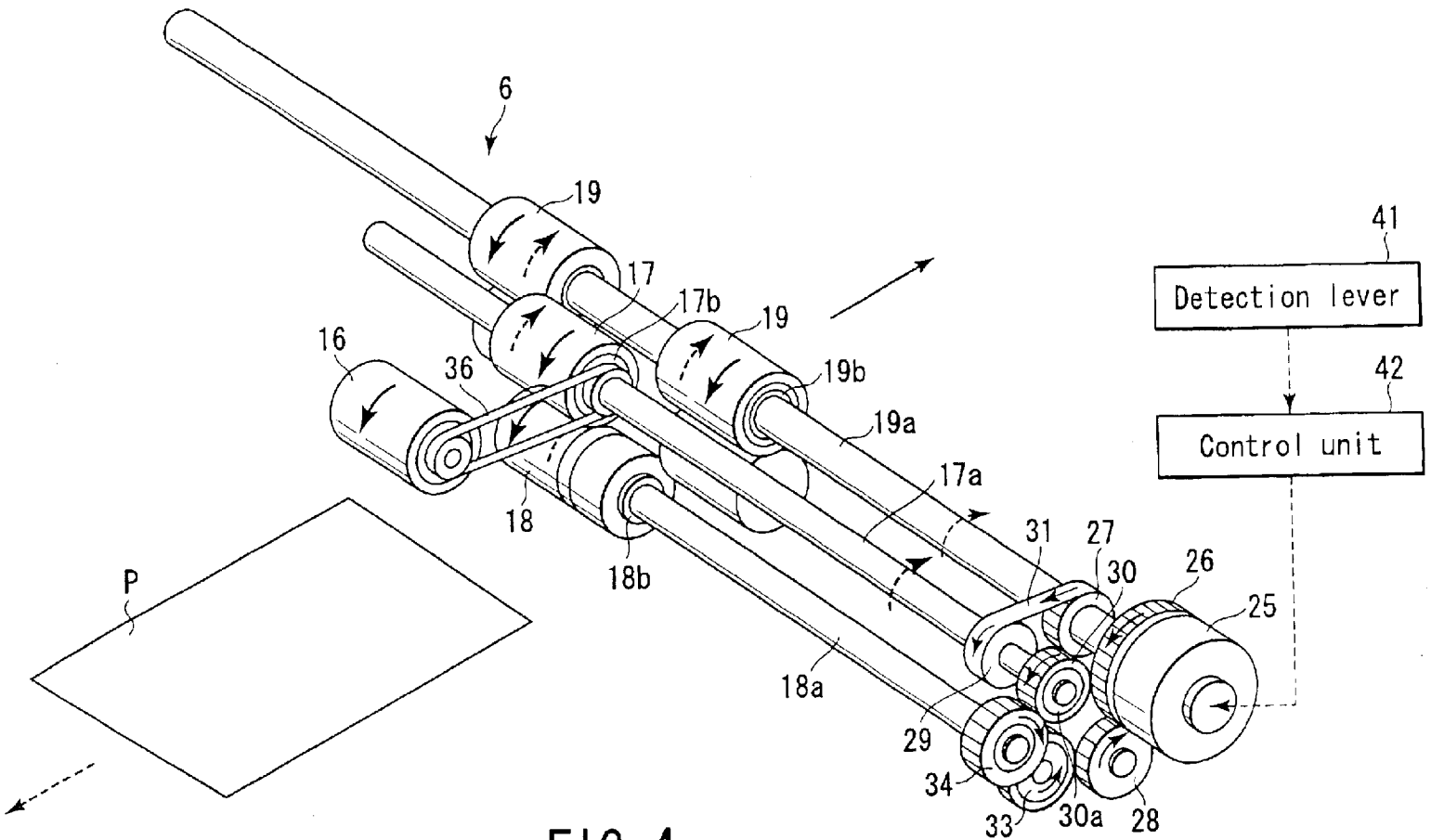
FIG. 4 is a perspective view showing a drive mechanism of the manual paper feeding unit.

FIG. 4 is a perspective view showing a power transmission system to transmit power to the paper feeding unit 6.

The carry roller 19 is provided on a shaft 19*a* (a third shaft), whose one end is provided with an electromagnetic clutch 25, a power receiving gear 26 and a first pulley 27. A drive gear 28 is connected to the power receiving gear 26. The drive gear 28 is rotated by a drive motor (not shown) in the arrow direction.

The paper feed roller 17 is provided on a shaft 17*a* (a first shaft), whose one end is provided with a second pulley 29 and a first gear 30. The first gear 30 contains one-way clutch 30 comprising a reversing device, to permit free rotation of the shaft 17*a* in the direction (indicated by a dashed line arrow) reverse direction to the paper feeding direction with respect to the first gear 30. A power transmission belt 31 is laid over the first pulley 27 and second pulley 29.

Figure 5:
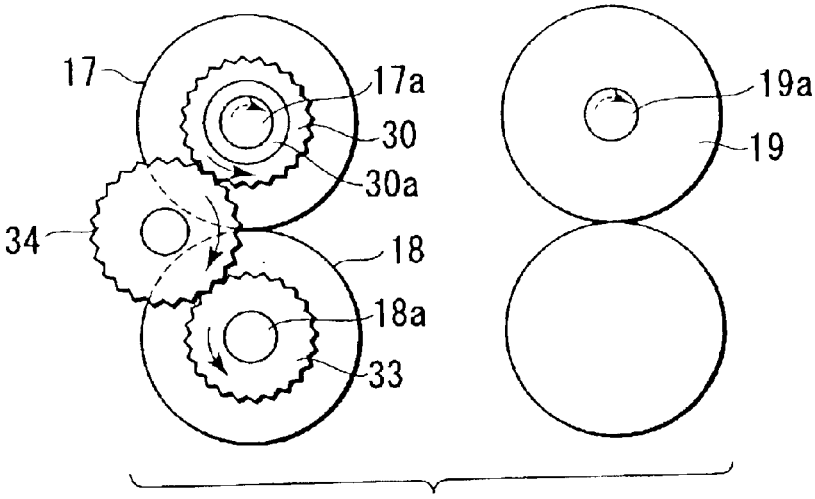
FIG. 5 is a magnified view showing a part of a power transmission mechanism of the drive mechanism.

The separation roller 18 is fixed to a shaft 18*a* (a second shaft), whose one end is provided with a second gear 33. The first gear 30 and second gear 33 are connected through an intermediate transmission gear 34, as shown in FIG. 5.

The intermediate transmission gear 34 is secured to a fixed stud (not shown), rotates only the arrow direction (clockwise) and does not rotate counterclockwise. Therefore, the second gear 30 which engages with the intermediate transmission gear 34 does not rotate clockwise (in the direction reverse to the paper feeding direction).

The paper feed roller 17 and pickup roller 16 are connected through the power transmission belt 36.

The paper feed roller 17 and carry roller 19 contain one-way clutch 17*b* and 19*b*, respectively. When a rotating force in the solid line arrow direction is applied to the outer circumference of the paper feed roller 17 and carry roller 19, the rollers rotate freely with respect to the shaft 17*a* and 19*a*.

The separation roller contains a torque limiter 18*b*. When a sheet of paper is fed between the paper feed roller 17 and separation roller 18, the separation roller 18 rotates following the rotation of the paper feed roller 18. However, when two or more sheets of paper are fed between the paper roller 18 and separation roller 18, the coefficient of friction with the paper is lowered, and the torque limiter 18*b* of the separation roller 18 functions and rotates reversely to separate the paper P.

The first gear 30 fixed to the shaft 17*a* of the paper feed roller 17 contains a one-way clutch 30*a*, and the shaft 17*a* can be freely rotated clockwise (in the direction reverse to the paper feeding direction) against the second gear 30, as indicated by the dashed line arrow.

By turning off the electromagnetic clutch 25, the connection of the shaft 19*a* of the carry roller 19 and the power receiving gear 26 is released, and the shaft 19*a* of the carry roller 19 can be freely rotated clockwise (in the direction reverse to the paper feeding direction) against the power receiving gear 26, as indicated by the dashed line arrow.

Turning on/off of the electromagnetic clutch 25 is controlled by a control unit 42. The control unit 42 turns on the electromagnetic clutch 25 based on the paper detection signal sent from the detection lever 41. When receiving the paper detection signal from the detection lever 41 continuously for over a predetermined time, the control unit 42 judges it a paper jam and turns off the electromagnetic clutch 25.

Next, manual paper feeding will be explained.

First, open the manual feeding paper tray 15, place paper on the tray 15, and insert the tray. The detection lever 41 functions and detects the paper P. The paper P detection signal is sent to the control unit 42. The control unit 42 turns on the electromagnetic clutch 25, and connects the power receiving gear 26 and shaft 19*a*.

Figure 6:
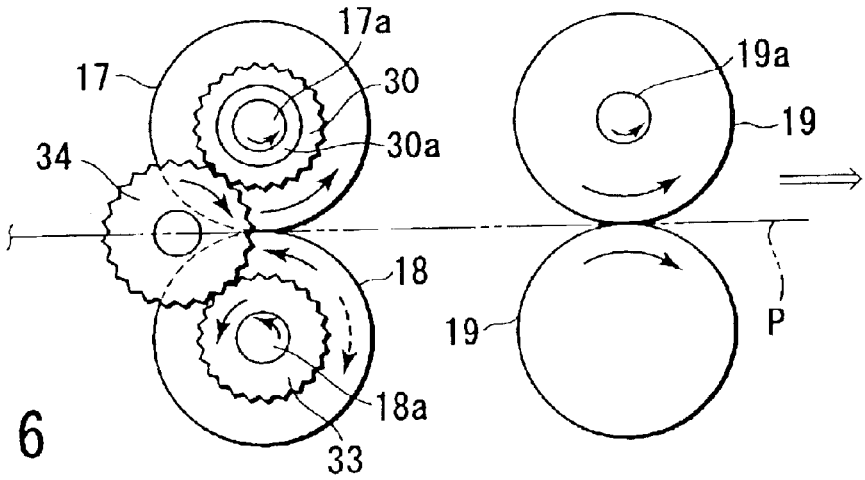
FIG. 6 is a view showing the paper feeding operation of the manual paper feeding unit.

The drive gear 28 rotates, and the rotation force is transmitted to the carry roller 19 through the gear 26 and shaft 19*a*, and the carry roller 19 is rotated in the paper feeding direction (the direction indicated by the solid line arrow), as shown in FIG. 6.

When the shaft 19*a* rotates, the shaft 17*a* is rotated through the first pulley 27, power transmission belt 1 and second pulley 29, and the paper feed roller 17 is rotated in the paper feeding direction (the direction indicated by the solid line arrow).

When the shaft 17*a* rotates, the shaft 18*a* is rotated through the first gear 30, intermediate transmission gear 34 and second gear 33, and the separation roller 18 is rotated in the direction (indicated by the solid line arrow) reverse to the paper feed roller 17 in the press contacting part with the paper feed roller 17.

Further, when the paper feed roller 17 rotates, the pickup roller 16 is rotated in the paper feeding direction (indicated by the solid line arrow) through the power transmission belt 36.

By the rotation of the pickup roller 16, the paper P placed on the manual feeding paper tray 15 is picked up, fed between the paper feed roller 17 and separation roller 18, and the sheets of paper are separated one by one and fed by the rotations of the paper feed roller 17 and separation roller 18 in the direction indicated by the solid line arrow. The fed paper P is sent to the carry roller pair 19, and held and carried and sent to a registration roller 23 by the rotation of the carry roller pair 19. The paper position is adjusted by the registration roller 23. In this time, the paper P passes through the detection lever 41, and the transmission of the detection signal from the detection lever 41 to the control unit 42 is stopped. Then, the control unit 42 turns off the electromagnetic clutch 25, and releases the connection between the power receiving gear 26 and shaft 19*a*. The paper P is carried to the image forming unit 5 by the rotation of the registration roller 23. The one-way clutch 19*b* and 17*b* of the carry roller pair 19 and paper feed roller 17 function, and the rollers rotate freely in the direction indicated by the solid line arrow with respect to the shafts 19*a* and 17*a*. By the function of the torque limiter 18*b*, the separation roller 18 rotates in the direction indicated by the dashed line arrow with respect to the shaft 18*a*.

The paper P whose position is adjusted by the registration roller 23, is carried to the image transfer unit 5, where the toner image on the photoconductive drum 8 is transferred. The toner image transferred paper is sent to the fixing unit (not shown), where the toner image is fixed and the paper is ejected.

During the manual paper feeding, the paper P may not pass through between the paper feed roller 17 and separation roller 18, and the rear end jams projecting rearward from between the paper feed roller 17 and separation roller 18.

In this case, the detection lever 41 emits the paper detection signal for over a predetermined time, and the control unit 42 receives the signal, judges that the paper P jams, and turns off the electromagnetic clutch 25. The connection of the power receiving fear 26 and shaft 19*a* is released, and the rotations of the paper feed roller, separation roller 18, carry roller pair 19 and pickup roller 16 will be stopped. In this state, the operator catches the rear end of the paper P by hand, and pulls the paper P in the direction reverse to the paper feeding direction.

Figure 7:
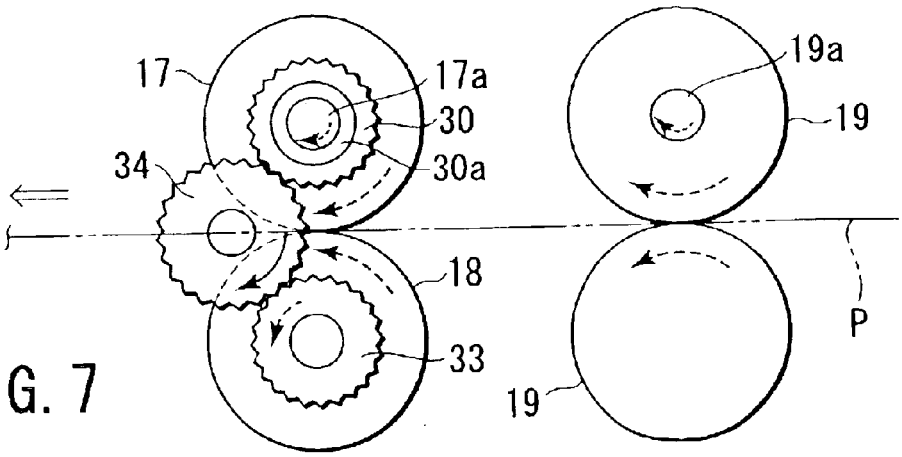
FIG. 7 is a view showing removal of a jammed paper in the manual paper feeding unit.

Since the power receiving gear 26 is disconnected from the shaft 19*a* in this time, when the paper P is pulled in the direction reverse to the paper feeding direction, the carry roller 19 rotates in the direction reverse to the paper feeding direction, as shown in FIG. 7.

Further, as the first gear 30 fixed to the shaft 17*a* of the paper feed roller 17 contains the one-way clutch 30*a*, when the paper P is pulled in the direction reverse to the paper feeding direction, the paper feed roller rotates in the direction reverse to the paper feeding direction, as indicated by the dashed line arrow, and the separation roller 18 also rotates in the direction reverse to the paper feeding direction, as indicated by the dashed line arrow.

As the carry roller pair 19, paper feed roller 17 and separation roller 18 rotate in the direction reverse to the paper feeding direction, the paper P is smoothly pulled out and removed in the direction reverse to the paper feeding direction.

The intermediate transmission gear 34 rotates clockwise only when the paper feed roller 17 rotates in the paper feeding direction, as explained above, and does not rotate counterclockwise.

Therefore, when the one-way clutch 30*a* is not contained in the first gear 30, the shaft 17*a* of the paper feed roller 17 cannot rotate in the direction reverse to the paper feeding direction, and the paper P cannot be pulled out.

In this embodiment, the second gear 30 contains the one-way clutch 30*a*, and the shaft 17*a* of the paper feed roller 17 and the shaft 19*a* of the carry roller 19 can be reversely rotated, and the paper P can be pulled out.

Therefore, a jammed paper can be removed without using a pressed contact release mechanism to separate the paper feed roller 17 from the separation roller 18 by interlocking with the opening of the open/close door 21, as in the conventional system, and the cost can be reduced.

Further, it is unnecessary to open the open/close door 21, and paper is not damaged when a jammed paper is removed.

It is of course to be noted that the present invention is not limited to the above-explained embodiment, and can be modifiable within the range of the essential characteristic.

The invention can be embodied in various forms by combining the components disclosed in the above-mentioned embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A manual paper feeding apparatus comprising:

a tray for manual paper feeding; a paper feed roller to feed the paper fed manually from the tray;

a separation roller which is pressed to contact the paper feed roller, rotated at the pressed contact position in the direction reverse to the paper feed roller, and separates sheets of paper one by one;

a power transmission device to transmit power to the paper feed roller and separation roller; and a reversing device which is provided in the power transmission device, and rotates the paper feed roller in the direction reverse to the paper feeding direction, based on that the paper fed between the paper feed roller and separation roller is pulled in the direction reverse to the manual feeding direction.

2. A manual paper feeding apparatus according to claim 1, wherein the power transmission device comprises:

a first shaft to fix the paper feed roller, and a second shaft to fix the separation roller;

a first and second transmission gears which are provided at one end of the first and second shafts, and transmit power; and an intermediate transmission gear which is provided rotatively only in one direction between the first and second transmission gears, and transmits the rotation force of the first transmission gear to the second transmission gear; and the reversing device has a one-way clutch which is contained in the first transmission gear, and rotates the first shaft of the paper feed roller freely against the first transmission gear, based on that the paper fed between the paper feed roller and separation roller is pulled in the direction reverse to the paper feeding direction.

3. A manual paper feeding apparatus comprising:

a tray to receive the paper fed manually;

a pickup roller to pick up the paper fed manually to the tray; a paper feed roller to feed the paper picked up by the pickup roller;

a separation roller which is pressed to contact the paper feed roller, and rotated at the pressed contact position in the direction reverse to the paper feed roller, and separates the paper one by one;

a pair of carry rollers to hold and carry the paper fed by the paper feed roller;

a power transmission device to transmit power to the pair of carry rollers, paper feed roller and separation roller; and a reversing device which rotates the carry roller and paper feed roller in the direction reverse to the paper feeding direction, based on that the paper fed to between the paper feed roller and separation roller, and between the pair of carry rollers, is pulled in the direction reverse to the manual feeding direction.

4. A manual paper feeding apparatus according to claim 3, wherein the power transmission device comprises:

a first shaft to fix the paper feed roller, a second shaft to fix the separation roller, and a third shaft;

first and second transmission gears which are provided at one end of the first and second shafts, and transmit power;

a third transmission gear which is provided at one end of the third shaft, and transmit power;

an intermediate gear which is provided rotatively only one direction between the first and second transmission gear, and transmits the rotation force of the first transmission gear to the second transmission gear;

a one-way clutch which is contained in the first transmission gear, and rotates the first shaft of the paper feed roller freely against the first transmission gear, based on that the paper fed to between the paper feed roller and separation roller is pulled out in the direction reverse to the paper feeding direction; and an electromagnetic clutch which disconnect the coupling between the third transmission gear and third shaft, rotates the third shaft of the pair of carry rollers freely against the third transmission gear, based on that the paper fed between the paper feed roller and separation roller, and between the pair of carry rollers, is pulled out in the direction reverse to the manual feeding direction.

* * * * *